US006005337A

United States Patent [19]

Papp et al.

[11] Patent Number: 6,005,337

[45] Date of Patent: Dec. 21, 1999

[54] SINGLE-ENDED DISCHARGE LAMP

[75] Inventors: Ferenc Papp; József Fülöp; István Würsching; Erzsébet Cserteg; József Tökés, all of Budapest, Hungary

[73] Assignee: General Electric Company, Schenectady, N.Y.

[21] Appl. No.: 08/998,848

[22] Filed: Dec. 29, 1997

[30] Foreign Application Priority Data

Dec. 30, 1996 [HU] Hungary ..... 9603622

[51] Int. Cl.[6] ..... H01J 5/48

[52] U.S. Cl. ..... 313/318.01; 318/318.04; 318/318.05; 318/493; 318/318.12; 439/602; 439/617

[58] Field of Search ..... 313/318.01, 318.02, 313/318.04, 318.05, 493, 634; 439/611, 612, 615, 617, 220, 226, 602; 315/58

[56] References Cited

U.S. PATENT DOCUMENTS 2,004,564 6/1935 Bol .
2,009,220 7/1935 Bol .
4,503,358 3/1985 Kamei et al. .
5,629,581 5/1997 Belle et al. .
5,691,598 11/1997 Belle et al. .

*Primary Examiner*—Ashok Patel
*Attorney, Agent, or Firm*—Fay, Sharpe, Fagan, Minnich & McKee, LLP

[57] ABSTRACT

The invention relates to a single-ended discharge lamp comprising a discharge tube, inleads connected to the electrodes of the discharge tube and embedded in the sealed portions thereof, a connection member connected to the inleads directly or through an adapter circuit and suitable for connecting the discharge lamp to a power supply, and a housing having a shell supporting the discharge tube as well as a cap mounted on the connection member.

At least one primary inlead support member (23) and at least one secondary inlead support member (24) is provided on the inner side of the shell (21), each of the inlead support members (23, 24) has at least one fixing member (**23*a*, 24*a*) for clamping the inleads (16, 17, 18, 19) and at least some of the inleads are clamped in the fixing member(s) (23*a*) of the primary inlead support member(s) (23) and some but not all of the inleads are clamped in the fixing member(s) (24*a*) of the secondary inlead support member(s) (24). The number of the inleads (16, 17) clamped in the fixing member(s) (24*a*) of the secondary inlead support member(s) (24) is smaller than but at maximum equal to the number of the inleads (16, 17, 18, 19) clamped in the fixing member(s) (23*a*) of the primary inlead support member(s) (23**).

10 Claims, 2 Drawing Sheets

SINGLE-ENDED DISCHARGE LAMP

Figure 1:
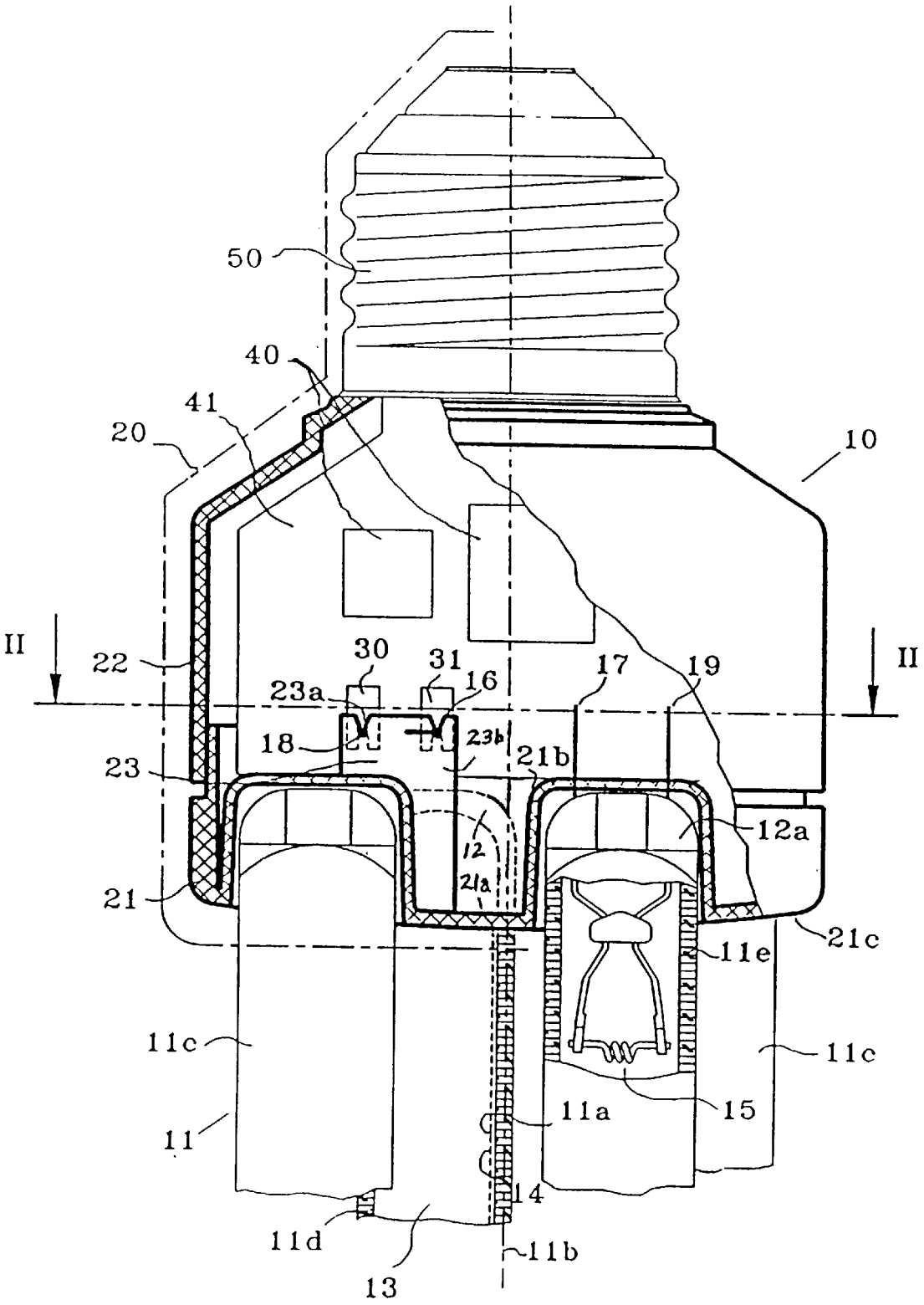

The invention relates to a solution for the arrangement of inlead wires of single-ended discharge lamps.

Single-ended discharge lamps, commonly referred to as compact fluorescent lamps, have gained widespread use both in the field of public lighting and home light sources recently. As a result of the development in the manufacturing process of these lighting devices, the outline dimensions of their discharge tubes have become close to those of conventional incandescent lamps.

This approximation of dimensions was based on the requirement that the luminaires designed for conventional light sources may be operated also with compact fluorescent lamps providing energy-saving operation and compact fluorescent lamps may be implemented simply without the need of using new luminaires.

However, a problem has occurred related to the use of compact fluorescent lamps, namely the market needs both their "screw-in" version having the same screw base as that of the incandescent lamps and their "plug-in" version having pins which are used normally with fluorescent lamps. This means that two different connection members are needed which causes that two different manufacturing processes must be used for the final assembling of the two versions. The problem is aggravated further by the need of automating the assembling process to the greatest possible extent in order to keep the costs at an acceptable level.

One obstacle to increasing the extent of automation is that the manufacturing of the two different connection members cannot be unified since the connection points of screw-in and plug-in versions are at different places. This has the consequence that the inlead wires are left free at the stage of assembling when the discharge tube is mounted on the shell of the housing attached to the connection member. The inlead wires may break or bend in this position which makes the nearly completed discharge lamp unusable for further assembling.

The problem outlined above has not been resolved so far, thus the objective of our invention is to eliminate the deficiencies of known designs and to create a single-ended discharge lamp having an inlead wire arrangement that allows the inlead wires to be placed into a position which is independent of the construction of the connection member used later in the assembling process with one single operation performed during mounting the discharge tube with the shell.

Another objective is that the discharge tube mounted on the shell may be simply stored, transported and handled as an intermediate product which in turn results in cost reduction of the manufacturing process in addition to its simplification.

The recognition that has led to the solution according to the invention is that the objective set can be achieved by providing the shell with inlead support members meeting specific requirements and fixing the inleads to these inlead support members appropriately.

The single-ended discharge lamp according to the invention comprises a discharge tube, inleads connected to the electrodes of the discharge tube and embedded in the sealed portions thereof, a connection member connected to the inleads directly or through an adapter circuit and suitable for connecting the discharge lamp to a power supply and a housing. The housing has a shell supporting the discharge tube and a cap mounted to the connection member. The objective set can be achieved if at least one primary inlead support member and at least one secondary inlead support member is placed on the inner side of the shell. Each inlead support member has at least one fixing member for clamping the inleads, and at least some of the inleads are clamped in the fixing members of the primary inlead support members and some but not all of the inleads are clamped in the fixing members of the secondary inlead support members.

The number of inleads clamped in the fixing members of the secondary inlead support members is less but at maximum equal to that of the inleads clamped in the fixing members of the primary inlead support members.

In a preferred embodiment of the discharge lamp according to the invention, all inleads are clamped in the fixing members of the primary inlead support members and only some of the inleads are also clamped in the fixing members of the secondary inlead support members.

In another embodiment of the discharge lamp according to the invention, each secondary inlead support member contains support protrusions protruding from the inner side of the shell and a seat placed between the support protrusions for accepting a contact member.

It is preferable if the fixing members of each secondary inlead support member are slots formed in the support protrusions.

In a further embodiment of the discharge lamp according to the invention, the shell of the housing is provided with support seats accepting at least some of the tube portions of the discharge tube which are close to the sealed portions, and at least some of the secondary inlead support members protrude from the support seat.

In a preferred embodiment, two secondary inlead support members being independent of each other are arranged on the inner side of the shell.

It is preferable if the secondary inlead support members are arranged symmetrically with respect to a first main plane passing through the longitudinal axis of the lamp and extending between the ends of the discharge tube.

In a further preferred embodiment of the discharge lamp according to the invention, the angle made by the direction line passing through the fixing members of the primary inlead support member on one side of the first main plane and being parallel thereto and starting from the sealed portion of the discharge tube, and by another direction line passing through the fixing members of the secondary inlead support member placed on the same side of the first main plane and starting from the primary inlead support member is an acute angle.

It is also a preferred embodiment of the single-ended discharge lamp according to the invention in which the discharge lamp has a second main plane passing through its longitudinal axis and being perpendicular to the first main plane. In this embodiment, there are two equal distances. One distance extends from a junction point of a contact member and the inlead embedded in one of the sealed portions, and clamped in the fixing member of the primary inlead support member, to the first intersection point obtained by projecting the said junction point perpendicularly to the second main plane. The other distance extends from a junction point of another contact member and the inlead embedded in the same sealed portion, and clamped in the fixing member of the secondary inlead support member, to a second intersection point obtained by projecting this junction point perpendicularly to the second main plane.

The most important advantage of the single-ended discharge lamp according to the invention is that the inlead arrangement differing from the known ones allows the discharge tube provided with the shell to be suitable for a housing with any connection member. Due to this, no further operation is needed to arrange the inleads prior to final assembling.

In addition to the cost reduction of assembling, the importance of this advantage is increased by that the discharge tubes provided with shells and assembled according to the invention may be stored at one place without the need for their distinction and separation corresponding to their further use.

It has to be considered also an advantage that, due to the unified arrangement of inleads, the hazard of bending and damaging of the inleads left free is eliminated. This results in a further simplification of storage since the use of protective parts and special storage units that increase the costs of production and assembling will not be necessary.

It is also a favorable feature that, due to the specific arrangement, the operation of fixing the inleads on the support members can be simply automated resulting in a further opportunity for the reduction of manufacturing costs.

Figure 2:
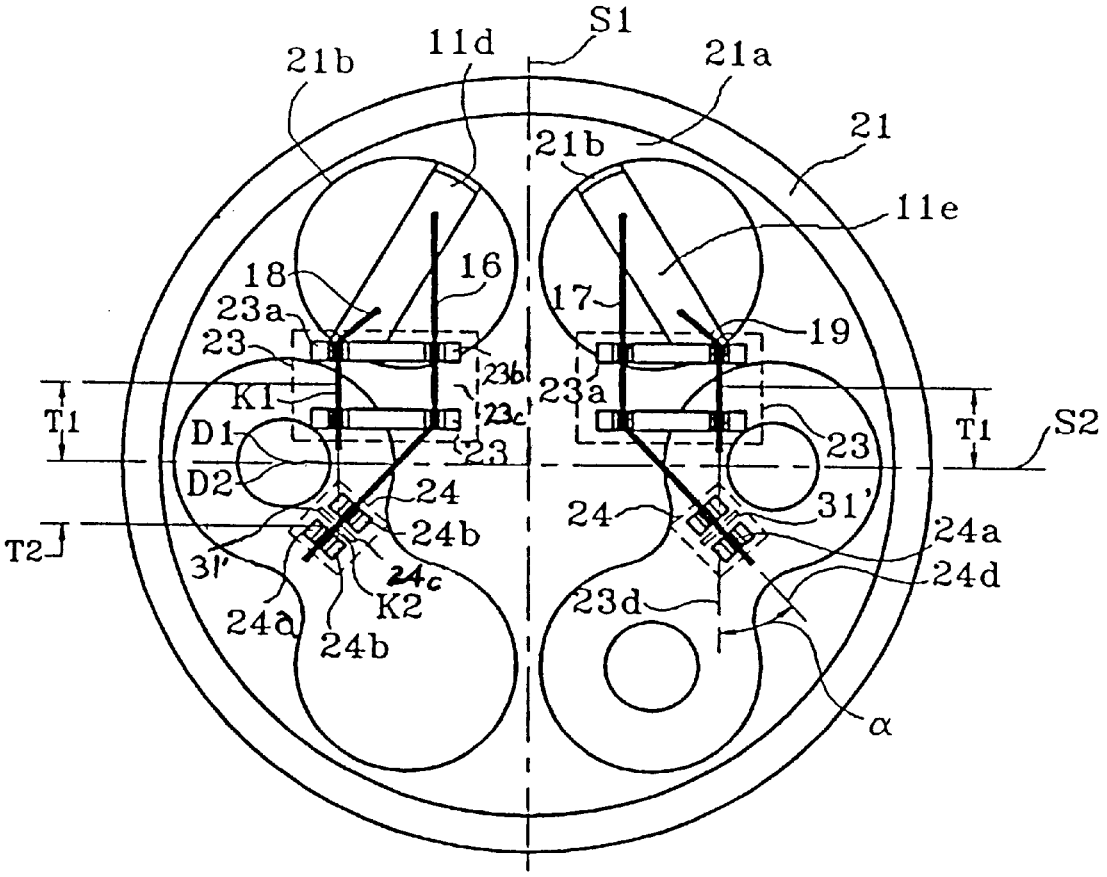

In the following, the invention will be described in more detail using an embodiment illustrated by a drawing in which FIG. 1 is a side view of a preferred embodiment of the single-ended discharge lamp according to the invention shown partly in section and FIG. 2 is a section of FIG. 1 taken along the plane II—II.

FIG. 1 shows a single-ended discharge lamp 10 in screw-in version. Discharge tube 11 comprises substantially parallel tube portions 11*c* and bent arc-shaped portions (not shown) connecting the said tube portions 11*c* in a known way and allowing a discharge to take place. The inner surface 11*a* of the discharge tube 11 covered with a coating layer 14 surrounds a discharge space 13. The discharge space 13 is closed by sealed portions 12 and 12*a* at one end 11*d* and another end 11*e* of the discharge tube 11, respectively in order to allow a gas-tight bordering between the discharge space 13 and the outside environment.

Electrodes 15 are placed in the discharge space 13 at one end 11*d* (not shown) and the other end 11*e* of the discharge lamp 10. The said electrodes 15 are connected to contact members (of which contact members 30 and 31 are only shown) fixed in an electrically conducting manner to a circuit board 41 carrying electric components 40 of an adapter circuit through inleads 18, 16 embedded in the sealed portion 12 and inleads 17, 19 embedded in the sealed portion 12*a*, respectively. The circuit board 41 is also connected in an electrically conducting manner to connection member 50 which is an E27 base assembly in the present embodiment.

The discharge tube 11, the electrical components 40 and the connection member 50 are supported by a housing 20 comprising a shell 21 and a cap 22. Support seats 21*b* in which one end 11*d* and the other end lie of the discharge tube 11 are fixed, are indented into outer side 21*c* of the shell 21.

As illustrated by FIG. 1, primary inlead support members 23 and secondary inlead support members 24 (shown only in FIG. 2) protrude from inner side 21*a* of the shell 21. Support protrusion 23*b* of the primary inlead support member 23 is provided with two slit-like fixing members 23*a*. The inleads 16 and 18 are clamped in these fixing members 23*a* in the way shown in FIG. 2. Finally, the contact members 30 and 31 fixed to the circuit board 41 are pressed on the inleads 16 and 18.

In FIG. 2, the inner side 21*a* of the shell 21 of the single-ended discharge lamp 10 is illustrated in a possible arrangement position of the inleads 16 and 18 as well as 17 and 19. It is seen that the shell 21 forming a part of the housing 20 and fixed to the discharge tube 11 is provided with the primary inlead support members 23 and the secondary inlead support members 24 which are independent of the primary inlead support members 23 and protrude from another portion of the inner side 21 of the shell 21. The primary inlead support members 23 consist of support protrusions 23*b* being in line and seats 23*c* formed between the support protrusions 23*b*. The primary inlead support members 23 are parallel to a second main plane S2 passing through the longitudinal axis 11*b* of the single-ended discharge lamp 10. The support protrusions 23*b* are provided with fixing members 23*a* being slit-like and indented into the said support protrusions 23*b* in the present embodiment. The inleads 16 and 18 protruding from one end 11*d* of the discharge tube 11 are clamped in some of the said fixing members 23*a* while the inleads 17 and 19 protruding from the other end 11*e* of the discharge tube 11 are clamped in the rest of the said fixing members 23*a*.

It is also shown in FIG. 2 that the primary inlead support members 23 are positioned symmetrically with respect to a first main plane S1 being perpendicular to the second main plane S2 and also passing through the longitudinal axis 11*b* of the single-ended discharge lamp 10. Also, the secondary inlead support members 24 are in axially symmetrical positions with respect to the first main plane S1. Their positions are not parallel to the second main plane S2, and they make two separate construction units being independent of each other. Similarly to the primary inlead support members 23, the secondary inlead support members 24 also consist of support protrusions 24*b* and seats 24*c* formed between the support protrusions 24*b*. Fixing members 24*a* are placed on the support protrusions 24*b* of the secondary inlead support members 24 which fixing members 24*a* serve for clamping the inlead 16 or the inlead 17.

It is shown in FIG. 2 that the secondary inlead support members 24 are placed on the inner side 21*a* of the shell 21 of the housing 20 and junction points K2 between the inlead 16 or 17 and the respective contact members 31' are on the direction lines 23*d* passing through the fixing members 23*a* of the primary inlead support members 23 and being parallel to the first main plane S1. The said fixing members 23*a* clamp the inlead 18 and 19. Junction points K1 are produced by pressing the inlead 18 or the inlead 19 introduced through the fixing members 23*a* of the primary inlead support members 23 into the contact members 30. The junction points K1 are also placed on the corresponding direction line 23*d*. In addition, two equal distances are shown in FIG. 2: one distance T1 is between the junction point K1 and a first intersection point D1 obtained by projecting the said junction point K1 perpendicularly to the second main plane S2. Another distance T2 is between the junction point K2 and a second intersection point D2 obtained by projecting the said junction point K2 perpendicularly to the second main plane S2.

Due to the equality of the distances T1 and T2 and the symmetry of the two secondary inlead support members 24 with respect to the first main plane S1, the junction point K2 of the inlead 16, the junction point K2 of the inlead 17 and the junction point K1 of the inlead 18 as well as the junction point K1 of the inlead 19 form the vertices of a regular quadrangle. The center of this quadrangle is placed just on the intersection line of the first main plane S1 and the second main plane S2, i.e. on the longitudinal axis 11*b* of the single-ended discharge lamp 10. In order to obtain this arrangement and to make the assembling easier, the angle $\alpha$ made by the direction line 23*d* and another direction line 24*d* passing through the fixing members 24*a* of the secondary inlead support member 24 is preferably an acute angle.

When assembling the present preferred embodiment of the discharge lamp 10, the inleads 16, 18 and the inleads 17, 19 protruding from the respective sealed portions 12 and 12*a* of the discharge tube 11 and extending in the inner side 21*a* of the shell 21 provided with the discharge tube 11 are arranged so that the inleads 16 and 18 protruding from the sealed portion 12 are first introduced through the fixing members 23*a* of the primary inlead support member 23 and fixed in this position to the support protrusions 23*b* of the primary inlead support member 23. Then, after bending the inlead (the inlead 16 in this case) being closer to the first main plane S1, it is directed to reach the secondary inlead support member 24 and passed through the fixing members 24*a* indented into the support protrusions 24*b* of the said secondary inlead support member 24. Simultaneously with this operation, the steps described are carried out similarly with the inleads 17 and 19 protruding from the sealed portion of the other end 11*e* of the discharge tube 11. As a result, the inlead arrangement illustrated in FIG. 2 will be obtained.

Further assembling of the discharge tube 11 provided with the shell 21 may be carried out according to two options. In the event that the screw-in lamp 10 outlined in FIG. 1 is intended to be produced, the electrical components 40 mounted on the circuit board 41 normally used for this version are connected to the inleads 16, 17, 18, 19 of the discharge tube 11 so that the contact members 30 and 31 of the circuit board 41 are pressed on the corresponding inleads 16, 17, 18 and 19. When the contact members 30 and 31 are pushed into the seats 23*c* formed between the support protrusions 23*b*, they make an electrical contact with each of the corresponding inleads 16 through 19.

If a plug-in rather than a screw-in discharge lamp 10 is intended to be manufactured, four contact members 30 are placed (in an arrangement not shown in the figures) on the cap 22 of the housing 20 and fixed so that their positions correspond to the junction points K1 of the inleads 18 and 19 as well as to the junction points K2 of the inleads 16 and 17.

By pushing the cap 22 provided with four contact pins forming a regular quadrangle on the shell 21, some of the contact pins will make an electrical contact with the inleads 18 and 19 of the primary inlead support members 23 and the rest of the contact pins will make an electrical contact with the inleads 16 and 17 of the secondary inlead support members 24.

The embodiments shown are for the purpose of illustrating the invention and are not intended to restrict the scope of protection. It is intended that the scope of protection be determined by the appended claims.

We claim:

1. A single-ended discharge lamp comprising a discharge tube, inleads embedded in the sealed portions of the discharge tube and connected to electrodes, a connection member connected to the inleads directly or through an adapter circuit and suitable for connecting the discharge lamp to a power supply, and a housing having a shell supporting the discharge tube and a cap mounted to the connection member, at least one primary inlead support member (23) and at least one secondary inlead support member (24) is provided on the inner side of the shell (21), each of the inlead support members (23, 24) has at least one fixing member (23*a*, 24*a*) for clamping the inleads (16, 17, 18, 19) and at least some of the inleads are clamped in the fixing member(s) (23*a*) of the primary support member(s) (23) and some but not all of the inleads are clamped in the fixing member(s) (24*a*) of the secondary inlead support member(s) (24) and the number of the inleads (16, 17) clamped in the fixing member(s) (24) of the secondary inlead support member(s) (24) is no greater than the number of the inleads (16, 17, 18, 19) clamped in the fixing member(s) (23*a*) of the primary inlead support member(s) (23).

2. Single-ended discharge lamp according to claim 1 wherein all inleads (16, 17, 18, 19) are clamped in the fixing members (23*a*) of the primary inlead support members (23) while some but not all of the inleads (16, 17) are clamped in the fixing members (24*a*) of the secondary inlead support members (24).

3. Single-ended discharge lamp according to claim 1 wherein each of the secondary inlead support members (24) is provided with support protrusions (24*b*) protruding from the inner side (21*a*) of the shell (21) and a seat (24*c*) placed between the support protrusions (24*b*) for accepting a contact member (31').

4. Single-ended discharge lamp according to claim 3 wherein the fixing members (24*a*) of the secondary inlead support members (24) are slots indented into the support protrusions (24*b*).

5. Single-ended discharge lamp according to claim 1 wherein the shell (21) of the housing (20) is provided with support seats (21*b*) accepting at least some of the tube portions (11*c*) of the discharge tube (11) which tube portions (11*c*) are close to the sealed portions (12) and at least some of the secondary inlead support members (24) protrude from the support seats (21*b*).

6. Single-ended discharge lamp according to claim 1 wherein two secondary inlead support members (24) being independent of each other are arranged on the inner side (21*a*) of the shell (21).

7. Single-ended discharge lamp according to claim 1 wherein the secondary inlead support members (24) are arranged symmetrically with respect to a first main plane (S1) passing through the longitudinal axis (11*b*) of the single-ended discharge lamp (10) and extending between one end (11*d*) and another end (11*e*) of the discharge tube (11).

8. Single-ended discharge lamp according to claim 7 wherein the angle $\alpha$ made by a direction line (23*d*) passing through the fixing members (23*a*) of the primary inlead support member (23) on one side of the first main plane (S1) and being parallel thereto and starting from the sealed portion (12) of the discharge tube (11) and by another direction line (24*d*) passing through the fixing members (24*a*) of the secondary inlead support member (24) on the same side of the first main plane (S1) and starting from the primary inlead support member (23) is an acute angle.

9. Single ended discharge lamp according to claim 8 wherein a second main plane (S2) passes through a longitudinal axis (11*b*) of the lamp and being perpendicular to the first main plane (S1) and it has two equal distances: one distance (T1) extends from junction point (K1) of a contact member (30) and the inlead (18) embedded in one of the sealed portions (12) and clamped in the fixing member (23*a*) of the primary inlead support member (23) to the first intersection point (D1) obtained by projecting the said junction point (K1) perpendicularly to the second main plane (S2) and the other distance (T2) extends from junction point (K2) of another contact member (31') and the inlead (16) embedded in the same sealed portion (12) and clamped in the fixing member (24*a*) of the secondary inlead support member (24) to a second intersection point (D2) obtained by projecting the junction point (K2) perpendicularly to the second main plane (S2).

10. Single-ended discharge lamp according to claim 9 wherein the first intersection point (D1) of the second main plane (S2) coincides with the second intersection point (D2) of the second main plane (S2).

* * * * *